United States Patent [19]

van der Lely

[11] 3,971,174

[45] July 27, 1976

[54] PREFABRICATED BUILDINGS

[76] Inventor: Cornelis van der Lely, 7, Bruschenrain, Zug, Switzerland

[22] Filed: Jan. 16, 1973

[21] Appl. No.: 324,078

[30] Foreign Application Priority Data

Jan. 17, 1972 Netherlands ..... 7200627

[52] U.S. Cl. ..... 52/79; 52/90; 52/185; 52/236

[51] Int. Cl.[2] ..... E04H 1/00

[58] Field of Search ..... 52/79, 234, 236, 169 DT, 52/90, 185

[56] References Cited

UNITED STATES PATENTS

| | | | |
|---|---|---|---|
| 41,445 | 2/1964 | Ortwine | 52/185 |
| 3,254,458 | 6/1966 | van der Lely | 52/169 |
| 3,484,999 | 12/1969 | van der Lely | 52/79 |
| 3,494,091 | 2/1970 | Turturro | 52/745 |
| 3,541,748 | 11/1970 | Rothgeb | 52/143 |
| 3,552,075 | 1/1971 | Crump | 52/236 |
| 3,618,278 | 11/1971 | Mouton | 52/185 |
| 3,694,977 | 10/1972 | Verman | D13/1 A |

FOREIGN PATENTS OR APPLICATIONS

| | | | |
|---|---|---|---|
| 1,010,812 | 11/1965 | United Kingdom | 52/234 |
| 1,035,319 | 7/1966 | United Kingdom | 52/234 |

OTHER PUBLICATIONS

Aladdin Readi-Cut Homes by Aladdin Co., Copyright 1949, pp. 10 & 20.

Netherland Printed Application 6403369, to Texas Ind. Inc. of 9-1965.

*Primary Examiner*—John E. Murtagh
*Attorney, Agent, or Firm*—Mason, Mason & Albright

[57] ABSTRACT

Row houses wherein each house consists of four elongated parallelepiped prefabricated units having their longitudinal axes perpendicular to the front of the houses, the kitchen with the entrance hall (including a powder room) being disposed in two lower units at the front of each house and the living room being to the rear and also defined by the two lower units of the house. A stairway included to one side of the living room leads to a landing on a second floor consisting of two further units which are parallel to and superimposed on the two units which make up the lower floor. At the landing there are entrances to three bedrooms defined by the two second floor units and to a bathroom at the head of the stairway in the unit including the landing. The lower units are on a foundation which defines a basement having a furnace to provide central heating and an entrance from the first floor by a stairway disposed between the kitchen and living room which leads from the first floor to the basement. The units of the second floor are each supported by the underlying unit of the first floor. A garden is provided at the back of each house with a garage and/or tool shed behind the garden disposed at an angle to an access road and also to the back of the house.

22 Claims, 6 Drawing Figures

PREFABRICATED BUILDINGS

SUMMARY OF THE INVENTION

This invention relates to prefabricated buildings.

According to the present invention there is provided a prefabricated building having two or more stories, at least two of which consist of prefabricated room units that each have one wall located at the front of the erected building, a kitchen being in one part of one of these units so as to be at the front of the erected building, and another of these units, comprising the main entrance of the building, being provided at one side of the unit having the kitchen.

In a simple form the erected building further comprises a living room at its rear formed by two adjacent prefabricated room units.

In a further form the story of the erected building containing the living room, when formed by at least two adjacent prefabricated room units, also has an open staircase in the living room to give access to a second floor above the living-room story.

Advantageously, when the erected building comprises just two stories, there is a total of four prefabricated room units.

An effective disposition of the rooms of the erected building can be obtained by arranging in the bedroom story an intermediate partition parallel to the longer side walls of a prefabricated room unit and at a distance from the longer side walls of this unit.

In another form a story consisting of prefabricated room units is arranged, in the erected building, on a cellar which extends beneath the whole building.

For a better understanding of the invention and to show how the same may be carried into effect, reference will now be made, by way of example, to the accompanying drawings, in which:

DESCRIPTION OF THE PREFERRED EMBODIMENTS

Figure 1:
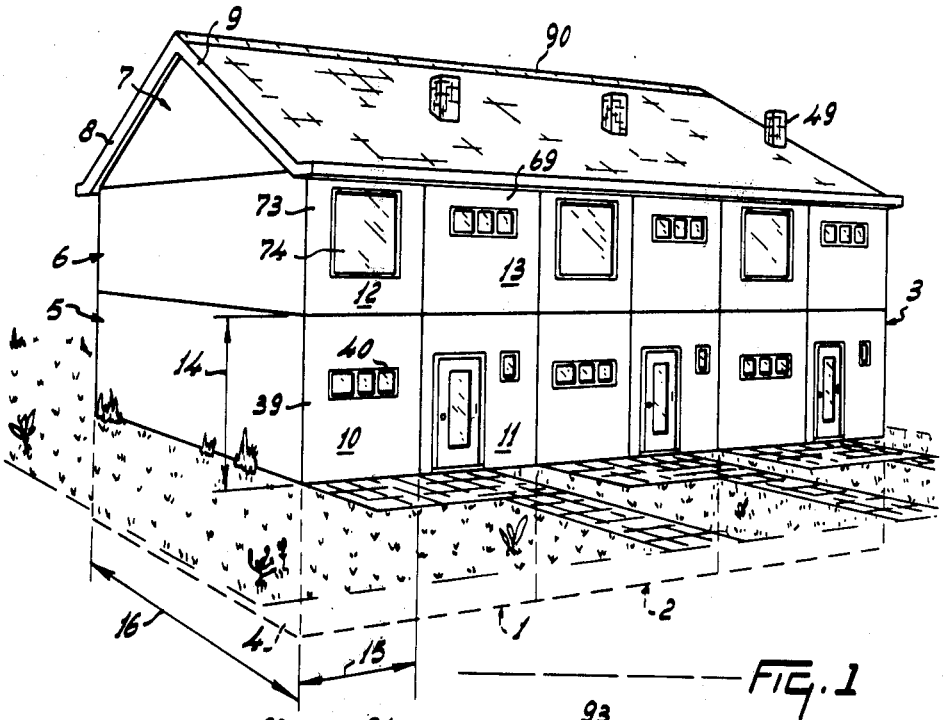
FIG. 1 is a perspective view of an erected row of prefabricated dwelling houses.

FIG. 1 shows a row of three buildings in the form of dwelling houses 1, 2 and 3, erected side by side in a single row. The houses are identical and the house 1 will be described in detail. The house 1 has a cellar 4, a ground floor story 5 and a second floor story 6 in which the bedrooms are disposed. On top of the second floor story 6 an attic or loft 7 is covered by inclined roof parts 8 and 9.

The cellar 4 is constructed at the building site and is preferably made of concrete. The stories 5 and 6 are each formed by two prefabricated room units each of an elongated parallelepiped box-shaped form, assembled together at the building site, while the roof is mounted on top of the assembled sections of the story 6 also at the building site. The units of the story 5 are designated 10 and 11 and those of the story 6 are designated 12 and 13.

Figure 5:
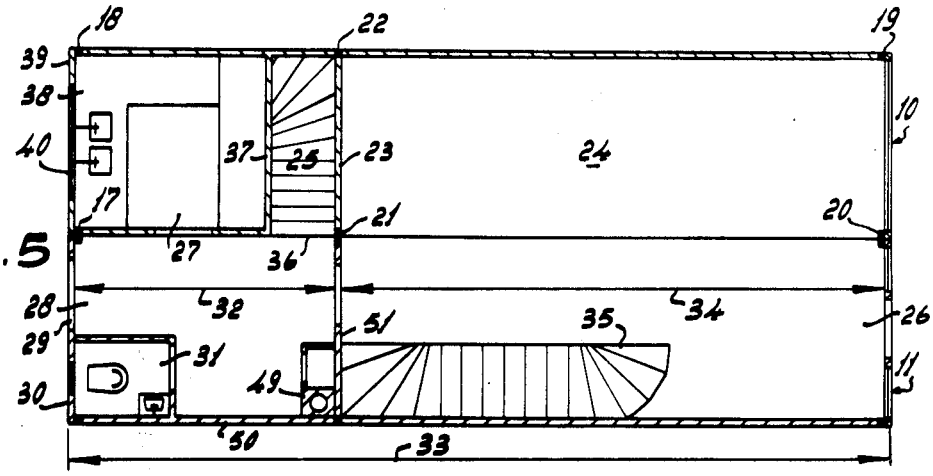
FIG. 5 is a floor plan of the ground floor of the house of FIG. 4.

Each of the units 10 to 13 is prefabricated as completely as practical and their external dimensions are the same. For example, each unit has a height 14 of about 2.80 ms, a width 15 of about 2.50 ms, measured along the facade, and a length 16 of about 11 ms. Each of the units has a supporting beam structure, to which the internal dividing walls and the outer walls are secured. In these walls windows and doors are provided as desired. FIG. 5 shows for the units 10 and 11 four vertical frame beams 17, 18, 19 and 20, disposed at vertical corner edges of the units and further vertical frame beams 21 and 22 disposed along the long walls of the units.

The vertical frame beams are preferably secured to horizontal frame beams mounted on horizontal faces (that is floor and ceiling faces) of the units. The positions of the vertical frame beams may be chosen to some extent freely with a view to division of the stories into living room, bedroom and other rooms located wholly or partly in a section, the positions of the dividing walls being determined by this choice. In the form illustrated the positions of the vertical frame beams 21 and 22 are chosen so that a wall 23 can be disposed between them, which forms a partition between the opening for a staircase 25 leading to the cellar 4 and a portion 24, disposed in the section 10, of a living room 26.

The ground floor story 5 has, in addition to the living room 26, a kitchen 27 and a hall 28. The living room 26 extends throughout the width of the house at the rear so that each of the units 10 and 11 contains half of the living room 26. The kitchen 27 is entirely within the unit 10, at the end thereof which is located on the front 30 of the house and extending over the entire width of the unit 10. The entrance 29 of the house is in the unit 11, also at the front of the house, and gives access to a hall 28 entirely within the unit 11 at the front of the house. The hall 28 is thus located at the side of the kitchen. A toilet room 31 adjoins the hall 28 at the side of the main entrance 29. The hall 28 and the kitchen 27 cover a length 32 approximately equal to one third of the overall length 33 of the elongated units 10 and 11 and hence the living room 26 covers a length 34 of the units 10 and 11 approximately equal to two-thirds of the length 33. The hall 28 has a door opening 36 giving access to the staircase 25 leading to the cellar 4 beneath the ground floor story 5. The staircase 25 joins at its top an opening in the floor of the unit 10 located between the walls 23 and 37 of the living room 24 and the kitchen 27 respectively. The kitchen 27 has a sink unit 38 along the shorter wall of the unit 10, that is at the front of the house. Above the sink 38 there is an elongated window 40 with three small panes.

Figure 4:
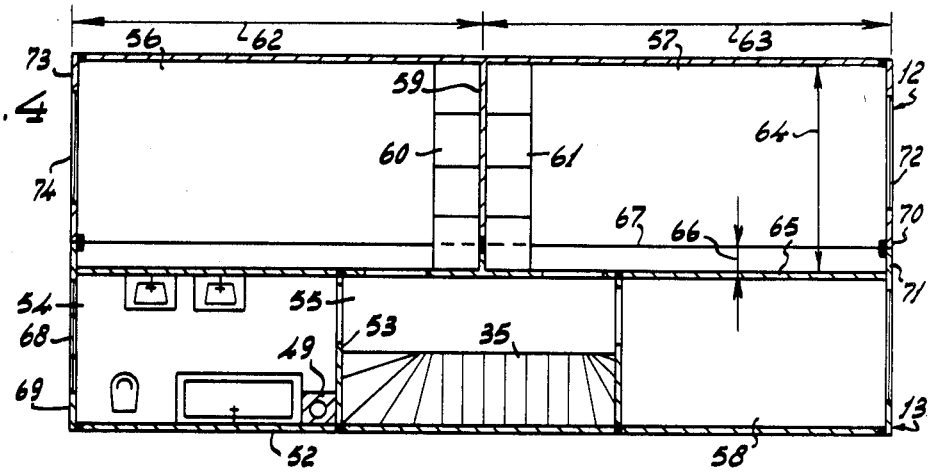
FIG. 4 is a floor plan of the top floor of one of the houses of FIG. 1.
Figure 6:
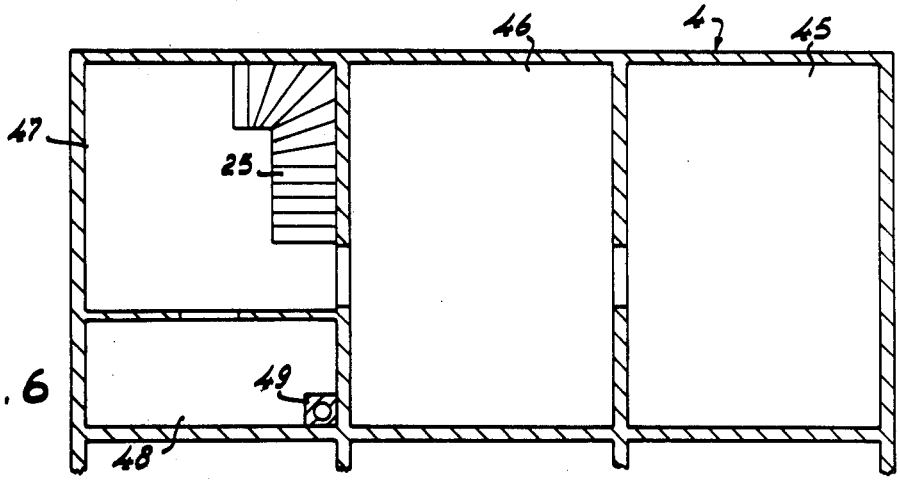
FIG. 6 is a floor plan of the cellar of the house of FIG. 4.

The cellar 4 (FIG. 6) is made of concrete cast at the building site. The cellar has rooms 45, 46 and 47 communicating with each other through doors, and a closet 48 suitable for accommodating heating equipment for central heating of the house, which is not shown in the figures. From the closet 48 a flue 49 extends upwardly. The flue 49 passes through the hall 28 at a corner between an outer wall 50 and a partition wall 51 between the hall 28 and the living room 26. In the bedroom story 6 (FIG. 4) the flue 49 runs in a corner between a wall 52 of the unit 13 and a wall 53 between the bathroom 54 and a landing 55. The flue 49 then passes through the roof, it being entirely vertical from the cellar 4 upwards.

The bedroom story 6, to which access is gained by to open staircase 35 from the living room 24 to the landing 55, has two bedrooms 56 and 57, a bathroom 54 and a bedroom 58. Between the bedrooms 56 and 57 a partition wall 59 is provided, along which cupboards 60 and 61 are disposed. The bedrooms 56 and 57 (inclusive of the cupboards) have lengths 62 and 63 respectively, which are approximately the same and thus equal to half the overall length 33 of the unit 12. The bedrooms 56 and 57 each have a width 64 which exceeds the width 15 of the unit 12 so that they are partly contained in the unit 13. The unit 13 has a partition wall 65 located at a distance 66 from and parallel to a longer side 67 of this unit. The partition wall 65 forms a separating wall between the bedrooms 56 and 57 on one hand and the bathroom 54, landing 55, and bedroom 58 on the other. By disposing the partition wall 65 at a distance from the longer side 67 of the unit 13 an advantageous division of the top story into the various rooms is obtained. The bedrooms and the bathroom have doors to the landing 55 with which in turn communicates the open staircase 35, the staircase 35 joining an opening in the floor of the unit 13, and the bathroom 54 and the bedroom 58 thus being located on opposite sides of the staircase 35. The said opening in the floor of the unit 13 is situated in about the middle of the length of the unit 13. The staircase 35 is extending parallel to the longer side of the units as seen in plan view. The bathroom 54 has a window 68 similar to the window 40 of the kitchen 27 and the facade portion 39 of the front of the unit 10 is identical to the facade portion 69 of the front of the unit 13. The bathroom 54 is located above the toilet room 31 and these rooms are both located at the front of the house, which is advantageous with respect to water supply and drainage ducts located near the front of the house. At the rear the facade portions 70 and 71 of the units 12 and 13 are identical, each having a window 72. The facade portion 73 at the front of the unit 12 is identical to the rear facade portions 70 and 71, having a window 74.

The space beneath the roof parts 8 and 9 forms a loft accessible through an opening in the top of the unit 13 located above the landing 55. This opening may accommodate a movable ladder covering, in its raised position, the opening in the ceiling of the landing 55, the ladder then lying in the loft. The ladder can be lowered to extend to the floor of the landing 55 to give access to the loft.

The width of each of the houses is equal to twice the width of one unit, the width of the house being about 5 ms. The longer sides of the units extend in the direction of depth of the house. With a unit length of 11 ms, the total ground surface area of each story is about 55 square meters. This surface area is preferably not smaller than about 50 square meters.

Figure 2:
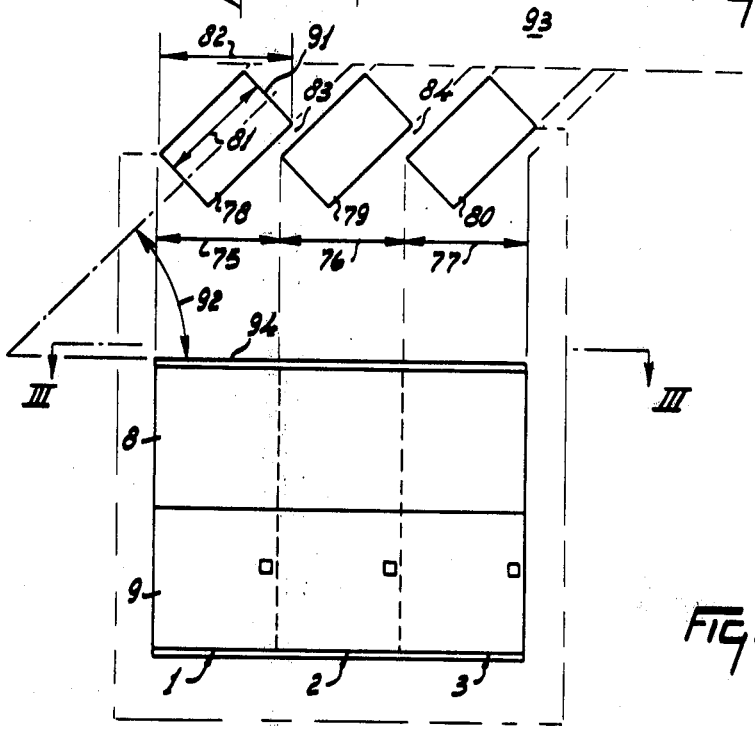
FIG. 2 is a diagrammatic plan view of the row of houses shown in FIG. 1.
Figure 3:
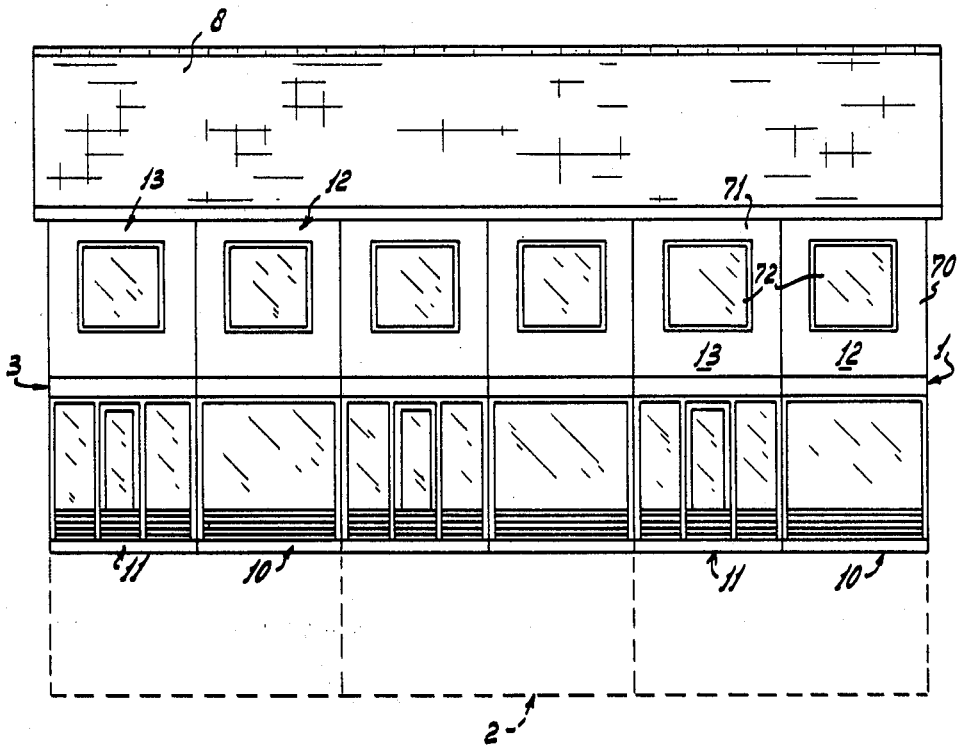
FIG. 3 is a rear elevation of the row of houses taken on the line III—III of FIG. 2.

Each of the houses 1, 2 and 3 has a garden 75, 76 and 77 respectively at the rear. In the rear parts of these gardens storing sheds 78, 79 and 80 are provided, which may be used as garages. In order to obtain a sufficient length 81 for the garages and a satisfactory access thereto with a garden width of not more than 5 ms (i.e. equal to the house width), the garages are disposed longitudinally inclined to the direction of depth of the houses, adjacent garages overlapping one another. The length 81 can therefore be chosen so that the dimension 82 occupied by each garage, measured in the direction of width of the garden, may exceed the width 75 of the garden. The length 81 may be larger than 5 ms. The garages are readily accessible (see the entrance side 91 of the garage 78) from the access road 93 laid parallel to the rear facade 94 of the houses. Since the direction of length of the garages is at an acute angle 92 to the rear facade of the houses and is inclined to the road 93, it is easy to drive into and out of the garages. In the layout shown in FIG. 2 narrow spaces are left between the garages 78, 79 and 80 for giving access to the gardens 75, 76. As an alternative, the garages may join each other so that the gardens are only accessible at the rear through the garages.

On the building site the cellar 4 of each house is first cast from concrete, the cellars of adjacent houses being made as a whole unit if so desired. On the cellars 4 the ground floor stories 5 of each of the houses 1, 2 and 3 are erected utilizing, for the story 5 of each house, two prefabricated room units 10 and 11 as described above. The units 10 and 11 have been situated so that the front 30 of the house preferably faces a road or street. By employing space-bounding, prefabricated, box-shaped room units as described, the stories 5 can be readily erected. The bedroom stories 6 are then erected on the stories 5, each of the units 12 and 13 of the higher story fitting to a unit of the lower story. The main part of each house, that is to say the living and bedroom stories 5 and 6, thus comprises only four prefabricated, box-shaped room units so that a rapid erection of these stories 5 and 6 on the building site is possible. On the bedroom stories 6 is erected the roof comprising the inclined parts 8 and 9. The loft space beneath the roof parts 8 and 9 is preferably separated by partitions located above the party walls between adjacent houses so that each house has an individual loft. Thus, the roof formed by the parts 8 and 9 is built at the building site on the top of the stories 6 but, as an alternative, the roof may be formed of prefabricated roof units.

Although in the illustrated embodiment inclined roof parts 8 and 9 are provided, a flat roof may be provided, in which case the roof can then be mounted on the units to form the stories 6 during the prefabrication process. In the illustrated embodiment the roof parts 8 and 9 are disposed so that the ridge 90 is parallel to the shorter sides of the units of the stories 5 and 6. It will be appreciated that the roof may be shaped in a different form.

Inasmuch as the longer sides of the adjacent houses join each other, there is no need for finishing them with an attractive appearance. Neither is it necessary for these sides to be water-tight, because they are covered by the adjacent house. This has a favorable effect on the costs of fabricating the units. Moreover, since each of the units where it joins an adjacent house has a closed wall, a double wall is formed between two neighboring houses so that desirable sound and heat insulation properties are obtained.

The units can be prefabricated in a workshop so that the manufacture of the units can be carried out rapidly and economically with greater accuracy. Since, for example, the facade portions 39 and 69 of the units 10 and 13 are identical and the rears 70 and 71 and the facade portion 73 of the units 12 and 13 are identical, a certain degree of uniformity is obtained, which simplifies further manufacture and improves economy.

As the two stories 5 and 6, which require a considerably better finish than the cellar 4, are formed of units fabricated away from the building site, work at the site can proceed rapidly with the desired finish being obtained, a satisfactory, constructional form of the units for the stories 5 and 6 being effectively carried out in a factory. The cellar 4 and the roof, if a less attractive finish is acceptable for them can be made practically completely on the building site.

By providing a large depth for the stories 5 and 6, for example a depth 33 of 11 ms, the width 15 of each house may be small. It is thus possible to construct each story 5 or 6 from not more than two units. If a further story is required on the story 6, for example for a hobby room and one or more further bedrooms, this further story may also be erected from two prefabricated units.

The small width 15 of each house gives a minimal length of frontage to a row of houses which maximizes the usage that can be made of supply and drainage ducts for gas, water and sewage. This has a favorable effect on the costprice of the buildings.

Although various features of the prefabricated buildings, have been described and illustrated in the drawings which will be set forth in the following claims as inventive features, it is to be noted that the invention is not necessarily limited to these features and that it encompasses all of the features that have been described and illustrated both individually and in various combinations.

Having thus described my invention, what I claim as new and desire to secure by Letters Patent of the United States is:

1. A row of houses wherein each house comprises a foundation defining a basement having a furnace, and a staircase, each house consisting of four parallelepiped elongated prefabricated units with two of said units of the first floor supported by said foundation over said basement in a connecting side-by-side arrangement and two further units of the second floor each supported by an underlying first mentioned unit, said second floor units also being connected in a side-by-side arrangement, said units together forming a box-shaped structure, the longitudinal axis of each unit being perpendicular to the front of the house, the front of the house having an entrance into the hall and kitchen beside the hall, a stairwell is provided for said staircase from the basement immediately behind said kitchen whereby said staircase communicates with said hall, the living room spanning the first floor units after said hall and said stairwell behind said kitchen and including a stairway, and landing receiving said stairway included in a unit of said second floor, said second floor units further defining three rooms having entrances from said landing and bathroom also having an entrance from said landing disposed at the head of said stairway is said unit including said landing.

2. A prefabricated building having two or more stories, at least two of said stories consisting of elongated prefabricated room units which each have one wall located at the front of the erected building and have their longer length perpendicular to the front of the erected building, the first story of the building having only two units each of which defines an outer wall along a longer outer side of the building and are adjacent, a kitchen being in one part of one of said units so as to be at the front of the erected building in the first story thereon and extending across its width, the walls defining said kitchen all being situated in said one unit and including said one wall, the other of these units in the first story of the building, comprising the main entrance of the building, being provided at one side of said one unit having the kitchen, said entrance being at the front of the erected building and communicating directly into a hall provided in the front part of the unit adjacent said kitchen, said hall having a width at least in part which is equal to the width of the unit in which it is situated, a living room which extends through said two adjacent room units being located at the rear of the erected building.

3. A prefabricated building having two or more stories, at least two of said stories consisting of elongated prefabricated room units, in which a living room story consists of at least two such units located side-by-side in the direction of width of the erected building with the living room extending over the width of these two units, said two units further containing a hall in one unit and a kitchen adjacent said hall in the other of said units which are separated from each other by a wall in the unit which includes the kitchen and from said living room by walls perpendicular to the length and crossing the width of said units and coplanar whereby one said crossing wall is an extension of the other of said crossing walls, said hall and said kitchen being of equal width and located in the first part of the building and said living room being located in the rear part of said building, an open staircase in the living room of said erected building, said open staircase leading to a story located above the story having the living room.

4. A prefabricated building comprising two superimposed stories each consisting of two adjacent elongated parallelepiped prefabricated room units, the said room units of the upper story being located with an accurate fit on said room units of the lower story, said room units of the lower story containing a living rooom, a hall, a bathroom and an open staircase, said living room extending across said two adjacent room units of the lower story and being provided with an open staircase to give access to the upper story located above said story having the living room, said open staircase being disposed in one of said lower story room units parallel to such unit's length and ending at a landing provided in a said room unit situated in the upper story, said room unit having said landing including a wall extending the unit's entire length, said wall being inboard from the longer side of the adjacent upper story unit, said landing and said bathroom being adjacent and located in the same upper story unit, an additional wall in said upper story unit separating said landing and said staircase from said bathroom, a hall in said lower story unit immediately under said upper story unit having said landing, said hall being separated from said living room and said staircase by a further wall which is immediately under and substantially coplanar with said additional wall.

5. A prefabricated building constituting a plurality of individual dwelling houses each comprising buildings as claimed in claim 4 erected adjacent each other in a single row such that elongated room units of two or more stories of immediately adjacent houses are located side by side along their long sides.

6. A prefabricated building comprising two or more stories, at least two of which consist of elongated parallelepiped prefabricated units, said units containing a living room, a hall, a bathroom and an open staircase, at least one of said units having a width of about 2.5 meters and a length of about 11 meters, the story having said living room consisting of at least two adjacent of said prefabricated room units, said open staircase being provided in said living room to give access to a second story located above the story having said living room, said open staircase being disposed in one of said adjacent prefabricated room units parallel to its length and ending at a landing provided in a further of said elongated parallelpiped units situated in said second story, said further unit including a wall extending the length of the unit which is inboard from the longer side of the said unit on the same story adjacent thereto, said landing being adjacent said bathroom which is located in said further unit, an additional wall in said further unit separating said landing and said staircase from said bathroom, a hall in said prefabricated unit immediately under said further unit, said hall being separated from said living room and said staircase by a further wall which is immediately under and substantially coplanar with said additional wall.

7. A prefabricated building comprising two or more stories each of which has a floor area of at least about 50 squaare meters, at least two of said stories consisting of elongated parallelpiped prefabricated units which contain a living room, a hall, a bathroom and an open staircase, said story having said living room consisting of at least two adjacent of said prefabricated room units, said open staircase being provided in said living room to give access to a second story located above the story having said living room, said open staircase being disposed in one of said adjacent prefabricated room units parallel to its length and ending at a landing provided in a further of said elongated parallelepiped units situated in the next higher story, said further unit including a wall extending the length of the unit which is inboard from the longer side of the unit adjacent thereto on the same story, said landing being adjacent said bathroom which is located in said further unit, an additional wall in said further unit separating said landing and said staircase from said bathroom, a hall in said prefabricated unit immediately under said further unit, said hall being separated from said living room and said staircase by a further wall which is immediately under and substantially coplanar with said additional wall.

8. A prefabricated building comprising two or more stories, at least two or said stories consisting of elongated parallelepiped prefabricated room units, said room units containing a living room, a hall, a bathroom and an open staircase, a main entrance to the building being disposed in a said room unit having said hall, said hall containing said main entrance and giving access to a toilet room, the story having said living room consisting of at least two adjacent to said prefabricated room units, said open staircase being provided in said living room to give access to a second story located above the story having said living room, said open staircase being disposed in one of said adjacent prefabricated room units parallel to its length and ending at a landing provided in a further of said elongated parallelepiped units situated in the next higher story, said further unit including a wall extending the length of the unit which is inboard from the longer side of the next adjacent unit in said story, said landing being adjacent said bathroom which is located in said further unit, an additional wall in said further unit separating said landing and said staircase from said bathroom, a hall in said prefabricated unit immediately under said further unit, said hall being separated from said living room and said staircase by a further wall which is immediately under and substantially coplanar with said additional wall.

9. A prefabricated building comprising two or more stories, at least two of said stories consisting of elongated parallelepiped prefabricated room units, said room units containing a living room, a hall, a bathroom and an open staircase, said story having said living room consisting of at least two adjacent of said prefabricated room units, said two adjacent room units having an open staircase which is provided in said living room to give access to a second story located above said story having said living room, said open staircase being disposed in one of said adjacent prefabricated room units parallel to its length and ending at a landing provided in a further of said elongated parallelepiped room units situated in the next higher story, said further unit including a wall extending the length of the unit is inboard from the longer side of the next adjacent unit, at least one further room being defined by said wall extending the length of said further unit and the longer outer wall of the said unit next adjacent thereto, said landing being adjacent said bathroom which is located in said further unit, an additional wall in said further unit separating said landing and said staircase from said bathroom, a hall in said prefabricated unit immediately under said further unit, said hall being separated from said living room and said staircase by a further wall which is immediately under and substantially coplanar with said additional wall.

10. A prefabricated building comprising two or more stories, at least two of said stories consisting of elongated parallelepiped prefabricated units, said units containing a living room, a hall, a bathroom and an open staircase, a story having said living room consisting of at least two adjacent of said prefabricated room units, said open staircase in said two adjacent units being provided in said living room to give access to a second story located above the story having said living room, said open staircase being disposed in one of said two adjacent room units parallel to the length of said units and ending at a landing provided in a further of said elongated parallelepiped room units situated in said second story, said staircase terminating between the end portions of the longer side of said further room unit of said second story, said bathroom being disposed on one side of said staircase and a bedroom being disposed on the other side of said staircase, said further unit including a wall extending the length of the unit which is inboard from the longer side of the next adjacent unit on said second story, said landing being adjacent said bathroom which is located in said further unit, an additional wall in said further unit separating said landing and said staircase from said bathroom, a hall in said prefabricated unit immediately under said further unit immediately under said further unit, said hall being separated from said living room and said staircase by a further wall which is immediately under and substantially coplanar with said additional wall.

11. A prefabricated building as claimed in claim 10, wherein between the bathroom and the bedroom a landing communicates with the staircase.

12. A prefabricated building comprising two or more stories, at least two of said stories consisting of elongated parallelepiped prefabricated room units, said room units containing a living room, a hall, a bathroom and an open staircase, the story having said living room consisting of at least two adjacent of said prefabricated room units, said two adjacent prefabricated room units having said open staircase provided in said living room to give access to a second story located above the story having said living room, said open staircase being disposed in one of said adjacent prefabricated room units parallel to its length and ending at a landing provided in a further of said elongated parallelepiped room units situated in said second story, said further unit including a wall extending the length of said further unit which is inboard from the longer side of the next adjacent unit on said second story, said landing being adjacent said bathroom which is located in said further unit, an additional wall in said further unit separating said landing and said staircase from said bathroom, a hall in said prefabricated unit immediately under said further unit, said hall being separated from said further unit and said staircase by a further wall which is immediately under and substantially coplanar with said additional wall, each section of said second story being provided with a roof, each roof in said section comprising two inclined roof parts each of which inclines upwardly to meet at a ridge provided between the front and rear edges of said roof, said ridge extending substantially parallel to the front of the building and perpendicular to the longer sides of the units situated in said next higher story, a loft being provided between said roof and said units situated in said second story.

13. A prefabricated building comprising two superimposed stories each of which consists of two elongated parallelepiped prefabricated room units, said room units containing a living room, a hall, a bathroom and an open staircase, the two said room units consisting of the lower story having said living room and an open staircase provided in said living room to give access to a second story located above said story having said living room, said hall containing a main entrance to the building and giving access to a toilet room which is in the same room unit as said hall and said main entrance, said open staircase being disposed in one of said adjacent prefabricated room units parallel to the lenght thereof and ending at a landing provided in a further of said elongated parallelepiped room units situated in said second story, said further unit including a wall extending the length of the unit which is inboard from the longer side of the next adjacent unit of said second story, said landing being adjacent said bathroom which is located in said further unit, said bathroom in said second story being in one end of said further room unit and disposed in such end that it is located above said toilet unit end of said room unit below, said landing being disposed centrally in said further unit relative to the length of said further unit, an additional wall in said further unit separating said landing and said staircase from said bathroom, said hall in said prefabricated unit being immediately under said further unit, said hall being separated from said living room and said staircase by a further wall which is immediately under and substantially coplanar with said additional wall.

14. A prefabricated building as claimed in claim 13 wherein a story consisting of prefabricated room units is erected on a cellar which extends beneath the whole house.

15. A prefabricated building as claimed in claim 14 wherein the cellar is made from concrete.

16. A prefabricated building as claimed in claim 15 wherein the cellar is made from concrete cast on the building site.

17. A prefabricated building as claimed in claim 16 wherein the cellar includes a closet for accommodating heating equipment for central heating of the building.

18. A prefabricated building as claimed in claim 17 wherein from said closet a flue passes to the roof of the building, this flue extending up a corner of the entrance hall and a corner of the bathroom.

19. A prefabricated building as claimed in claim 13, wherein the facade of the building has a small, elongated kitchen window located at the front of the building.

20. A prefabricated building as claimed in claim 16 wherein there is a staircase between the entrance hall and the cellar, the staircase being located beneath an opening in the floor of the room unit that has a part of the kitchen and a part of the living room.

21. A prefabricated building as claimed in claim 19 wherein said bathroom story includes a room unit which has a facade portion identical to the facade portion having the small kitchen window.

22. A prefabricated building as claimed in claim 21 wherein rear facade portions of the room unit for a bedroom story are substantially identical and each have one window.

* * * * *